US006792201B1

(12) United States Patent
Tsai et al.

(10) Patent No.: US 6,792,201 B1
(45) Date of Patent: Sep. 14, 2004

(54) WATER HEATING DEVICE

(76) Inventors: Yen-Hui Tsai, 2F, No. 4-1, Lane 51, Mei Guei Road, Hsintien City, Taipei (TW); Ching Yi Lin, 3F, No. 63, Lane 269, Chong Ching Road, Panchiao City, Taipei (TW); Jay Shieh, 3F, No. 2, Lane 44, Chung Hwa Road Section 2, Taipei (TW)

( * ) Notice: Subject to any disclaimer, the term of this patent is extended or adjusted under 35 U.S.C. 154(b) by 0 days.

(21) Appl. No.: 10/623,636

(22) Filed: Jul. 22, 2003

(51) Int. Cl.[7] ..... F24H 1/10
(52) U.S. Cl. ..... 392/480; 237/19
(58) Field of Search ..... 392/480, 465, 392/466, 485

(56) References Cited

U.S. PATENT DOCUMENTS 6,663,011 B1 * 12/2003 Entleutner ..... 237/12.1
6,701,068 B2 * 3/2004 Lin ..... 392/480

* cited by examiner

*Primary Examiner*—Thor Campbell
(74) *Attorney, Agent, or Firm*—Rosenberg, Klein & Lee

(57) ABSTRACT

A water heating device is arranged between a water tank and a water faucet located below the water tank. Water from the water tank flows along a pipeline through the water heating device to the faucet. The water heating device includes a hydroelectric generation system including a turbine mounted in the pipeline and a generator coupled to the turbine by a shaft. Water flowing through the pipeline drives the turbine and thus causes the generator to generate electricity. The electricity is supplied to an electrical heater that heats the water flowing through the pipeline. A control unit controls the electricity supplied to the electrical heater thereby controlling the thermal energy transferred to the water. Thus, no external and independent energy source is required for heating the water.

1 Claim, 1 Drawing Sheet

WATER HEATING DEVICE

BACKGROUND OF THE INVENTION

1. Field of the Invention

The present invention generally relates to a water heating device, and in particular to a water heating device for heating water running along pipelines from a water supply to a faucet located below the water supply by first converting mechanical energy of the running water into electricity that is then employed to heat the water.

2. The Related Art

Household water supply systems are common in modern society. Most of the household water supply systems include a water heater for the supply of warm water, which is essentially necessary for residents of cold zones in winter. Conventionally, the water heater heats water by burning gas or by electricity. Both consume additional energy in heating water.

In summer time, the room temperature may be as high as 25–35° C., or ever higher. Water temperature that is suitable for most household applications is at most 34–40° C., which is approximately 10 degrees higher than the room temperature. Water is often over-heated when the conventional water heater is employed to heat the water in summer time, which leads to a waste of energy. In addition, cold water must be mixed with the over-heated water to make the water temperature appropriate for immediate use. This causes waste of water, which in turn leads to a waste of energy.

Such a 10 degree difference can be readily and sufficiently compensated by a low power heater, which consumes power of 100–200 W. However, such a low power heater is not available in the market and thus it is desired to provide a water heating device that meets the requirement of environment protection and not excessively heating water.

SUMMARY OF THE INVENTION

An object of the present invention is to provide a water heating device without an additional and independent supply of energy for saving of energy.

Another object of the present invention is to provide a water heating device that requires no independent energy supply while capable to supply properly heated water without over-heating so as to be environment friendly.

To achieve the above objects, in accordance with the present invention, there is provided a water heating device comprising a hydroelectric power generation system, an electrical heater that is powered by the hydroelectric power generation system and a control unit for controlling the electrical heater. The water heating device is arranged on a pipeline connecting a water supply at a high location and a water faucet at a low location below the water supply. Water flowing from the water supply to the faucet drives a turbine of the hydroelectric power generation system, which in turn drives a generator via a transmission shaft. The generator is electrically connected to the control unit and the electrical heater by wires for supply of electricity to the electrical heater, which heats the water flowing through the pipeline. Thus, without additional and independent external power supply, the water heating device of the present invention properly heats the water for supply properly heated warm water to the faucet.

BRIEF DESCRIPTION OF THE DRAWINGS

The present invention will be apparent to those skilled in the art by reading the following description of a preferred embodiment thereof, with reference to the attached sole drawing, labeled FIG. 1, which is a schematic system diagram of a water heating device constructed in accordance with the present invention.

DETAILED DESCRIPTION OF THE PREFERRED EMBODIMENTS

Figure 1:
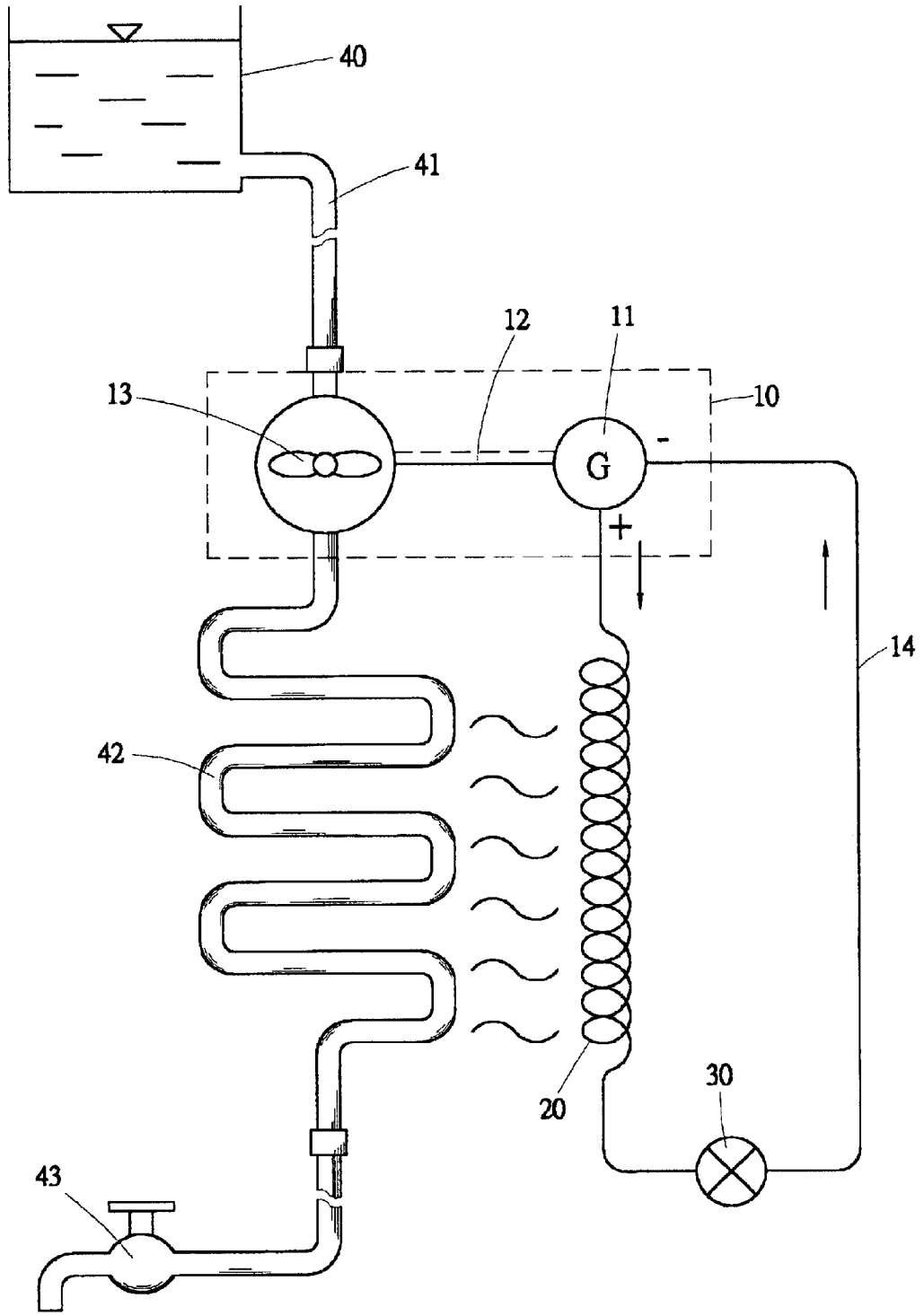

With reference to the sole drawing, FIG. 1, a water heating device constructed in accordance with the present invention comprises a hydroelectric generation system 10 that supplies electricity to an electrical heater 20 for heating water and a control unit 30 for controlling the operation of the electrical heater 20. The water heating device of the present invention is arranged between a water supply, such as a water tank 40 located at a high altitude, and a water consuming device, such as a faucet 43 located at a low altitude below the water tank 40 whereby water flows from the water tank 40 to the faucet 43 via a pipeline 41 under gravity. However, the principle of the present invention can be employed in other water supply systems provided water is running through pipelines with sufficient head for driving the hydroelectric generation system.

The hydroelectric generation system 10 comprises a generator 11 that is coupled to a turbine 13 by a transmission shaft 12. The turbine 13 is coupled to the pipeline 41 whereby when water flows through the pipeline 41, the head of the water drives the turbine 13 whereby the turbine 13 rotates. The rotation of the turbine 13 is transmitted to the generator 11 by the shaft 12, which causes the generator 11 to generate electricity. The electricity is supplied via electrical wires 14 to the control unit 30 and the electrical heater 20.

The electrical heater 20 and the control unit 30 are connected in series with the generator 11 by the electrical wires 14 whereby the electricity is supplied via the wires 14 to the control unit 30 and the electrical heater 20. The electrical heater 20 is arranged so that when the electrical heater 20 receives electricity from the generator 11, the electrical heater 20 heats the water flowing through a heating section 42 of the pipeline 41.

The control unit 30 controls the amount of electricity and power supplied to the electrical heater 20 so that the electrical heater 20 heats the water to a desired, proper range of temperature, without over-heating the water. Preferably, the control unit 30 comprises a rotary knob (not shown) for manual operation and control.

When the faucet 43 is opened, water, under the action of gravity, flows from the water tank 40 through the pipeline 41 (as well as the heating section 42 of the pipeline 41) to the faucet 43. The water flow drives the turbine 13 to rotate the generator 11 for electrical generation. The electricity generated is then supplied to the electrical heater 20 under the control of the control unit 30. Thus, no external and independent power supply is needed in heating the water.

In actual application, the water heating device of the present invention may be used to increase running water temperature from the room temperature to a higher level that is suitable for household applications, such as showering and cleaning purposes. Since the water is heated by the hydroelectric generation system, no additional energy is required, which realizes environmental protection and energy saving.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A water heating device adapted to be mounted to a water passageway through which water flows for heating the water, the water heating device comprising:

a hydroelectric generation system comprising:

a turbine mounted to passageway for being driven by the water flowing through the passageway, and a generator coupled to the turbine by a shaft whereby the generator is driven by the turbine to generate electricity; and an electrical heater mounted to a heated section of the passageway, the electrical heater being electrically connected to the generator for being powered by the electricity from the generator; and a control unit coupled to the electrical heater and the generator for controlling the electricity supplied to the electrical heater.

* * * * *